US009423210B2

(12) United States Patent
Pellegrini

(10) Patent No.: US 9,423,210 B2
(45) Date of Patent: Aug. 23, 2016

(54) HOLSTER SUPPORT

(75) Inventor: Paolo Pellegrini, Fucecchio (IT)

(73) Assignee: RADAR LEATHER DIVISION, S.R.L., Fucecchio (Firenze) (IT)

( * ) Notice: Subject to any disclaimer, the term of this patent is extended or adjusted under 35 U.S.C. 154(b) by 332 days.

(21) Appl. No.: 14/112,088

(22) PCT Filed: Apr. 19, 2012

(86) PCT No.: PCT/IB2012/051970
§ 371 (c)(1),
(2), (4) Date: Nov. 4, 2013

(87) PCT Pub. No.: WO2012/143882
PCT Pub. Date: Oct. 26, 2012

(65) Prior Publication Data

US 2015/0369563 A1 Dec. 24, 2015

(30) Foreign Application Priority Data

Apr. 20, 2011 (IT) ..... FI2011A0080

(51) Int. Cl.
*F41C 33/04* (2006.01)

(52) U.S. Cl.
CPC ..... *F41C 33/045* (2013.01)

(58) Field of Classification Search
CPC ..... F41C 33/045; F41C 33/0227; A45F 2005/025
USPC ..... 224/197–200
See application file for complete search history.

(56) References Cited

U.S. PATENT DOCUMENTS

2007/0023468 A1 2/2007 Ford

FOREIGN PATENT DOCUMENTS

WO WO 2006/076753 A1 7/2006
WO WO 2009/048584 A1 4/2009
WO WO 2009145850 A1 * 12/2009 ..... F41C 33/045

OTHER PUBLICATIONS

International Search Report and Written Opinion of PCT/IB2012/051970 dated Jul. 27, 2012.

* cited by examiner

*Primary Examiner* — Corey Skurdal
(74) *Attorney, Agent, or Firm* — Lucas & Mercanti, LLP

(57) ABSTRACT

The invention generally concerns the field of the accessories for fire-arms with which police officers, military men, private armed surveillance services and the like are equipped, More precisely the invention is directed to a system for connecting a holster or also a similar accessory to different wearing harnesses for carrying said holster or accessory. The support comprises a base plate, rotating disc to which the holster is fastened, locking means to releasably fix the disc in a selected angular position, and lever means pivotal with the plate for providing an abutment to said disc that prevents its separation from the plate.

10 Claims, 4 Drawing Sheets

HOLSTER SUPPORT

CROSS-REFERENCE TO RELATED APPLICATIONS

This application is a 371 of PCT/IB2012/051970, filed Apr. 19, 2012, which claims the benefit of Italian Patent Application No. FI2011A00080, filed Apr. 20, 2011, the contents of each of which are incorporated herein by reference.

FIELD OF THE INVENTION

The invention generally concerns the field of the accessories for fire-arms with which police officers, military men, private armed surveillance services and the like are equipped. More precisely the invention is directed to holsters for housing guns, and even more specifically it regards a system for connecting a holster or also a similar accessory such as a magazine holder, a VHF radio set, a dagger, to different wearing harnesses for carrying said holster or accessory, including thigh straps, belt loops, breast straps, and the like.

BACKGROUND OF THE INVENTION

It is to be understood that in the present description reference will be made for the sake of simplicity to a holster, being it clear that the invention can be applied in a completely analogous manner to any other of the above mentioned accessories. Similarly, even if reference will be made to the connection of the holster to a waist belt, the invention clearly encompasses the engagement with other harnesses, including those already mentioned, but also fixed holders applied to a furniture item such as a table, or to an inner wall face of a vehicle and so on.

As known, the holsters used by soldiers, guards, police officers etc. are applied to the service belt through a connection loop. European patent EP1479998, owned by the present applicant, discloses a fastening device for a holster ensuring a wide range of adjustment to the position of the holster adapting to the user's needs. The device comprises a loop for engagement with the belt, provided with a slide that permits to set the vertical displacement of the holster with respect to the same belt. The loop is connected to a holster attachment via an articulated joint allowing for an adjustment of the slant of the holster closer or farther to the body of the user about an axis tangential to the waist, while the same attachment permits to adjust the inclination of the holster with respect to the plumb line about a radial axis (i.e. substantially orthogonal with the user body surface). To this latter purpose the holster attachment comprises a connection plate housing a disc to which the holster is screwed. The disc can be rotated within the plate, in order to adjust the inclination of the holster, overcoming the resistance of locking means that in normal use conditions prevent the rotation.

SUMMARY OF THE INVENTION

The object of the present invention is to provide a holster support which, without jeopardizing the fundamental characteristic of a strong and safe connection for the holster, allows for an easy adjustment of the inclination of the same holster, and at the same time permits a comfortable and simple separation of the holster for connecting the same to other different supports.

This object is achieved with the holster support according to the present invention, having the essential features defined by enclosed claim 1. Other important features are encompassed by the dependent claims.

BRIEF DESCRIPTION OF THE DRAWINGS

The features and advantages of the holster support according to the invention will be apparent from the following description of an embodiment thereof, which is given merely by way of a non-limiting example, with reference to the attached drawings, in which.

DETAILED DESCRIPTION OF THE INVENTION

Figure 7:
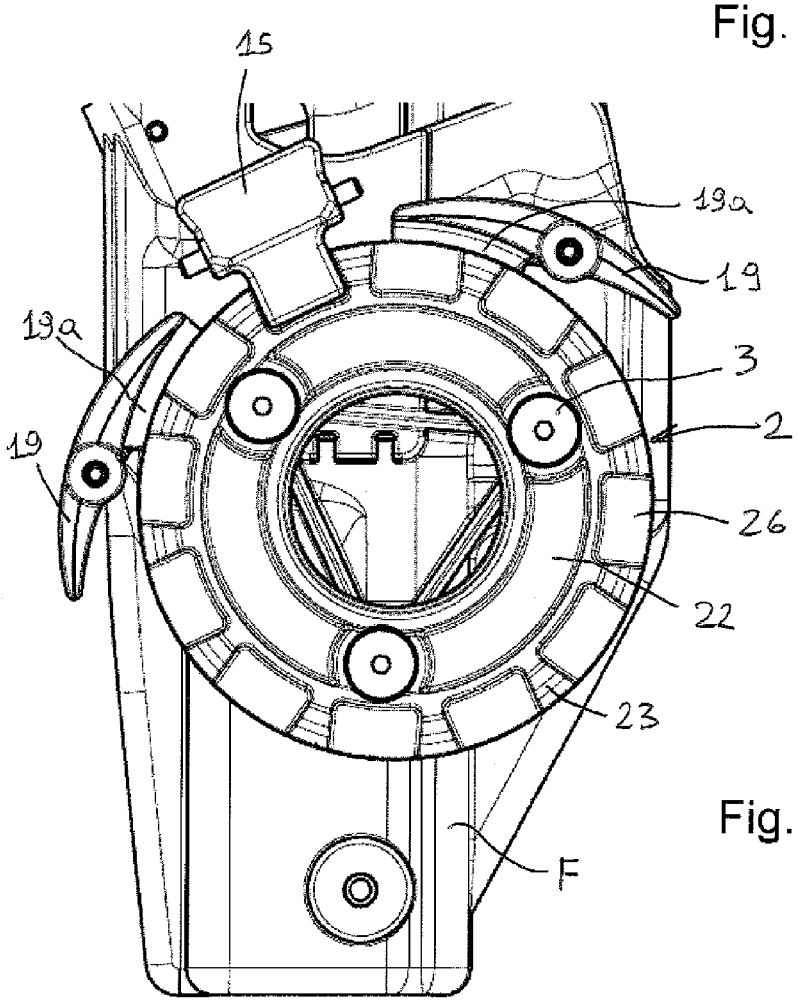
FIG. 7 is a top plan view of the support connected to a holster, the latter being represented only partially.

Referring to the above figures, the holster support according to the invention comprises a plate, generally indicated at 1, to be fastened, through screws 4, to a loop or other external attachment means, not shown, permitting to carry/wear the holster in different positions. Such external attachment means or harness may thus include a thigh strap, a breast strap, a loop for engagement with the waist belt, etc. The support further comprises a disc, generally indicated at 2, having a central axis X, coupled with the plate 1 so that the axis X results in a central position also with respect to the plate. The disc 2 is adapted to be connected with a holster F via screws 3 as shown in FIG. 7.

The plate 1 consists of a substantially annular flange 10 with an inner wall 11 from which a base 12 of the plate 1 extends over a plane orthogonal with the axis X. A seat 13 is defined by the base 12 for housing the disc 2. A radial recess 14 is also formed in the flange 10 for accommodating a lever push-button 15, elastically hinged, via a pivot 16 and a spring 17, to side walls of the recess 14 outside the seat 13. The pivoting axis of the push button 15 is therefore parallel with the plane of the disc. In a diametrical symmetry with respect to the recess 14, two windows 18 are formed in the wall 11 through which two radial tabs **19*a* project towards the common center of the plate 1 and of the disc 2. The radial tabs are integrally carried by the ends of respective levers 19 arranged inside housings 21 of the flange 10 and pivotally connected, via pivots 20, to the plate 1** with elastic means (springs, not shown in the drawings) hindering the pivoting.

The disc 2 has in turn an annular shape and comprises an inner ridge 22 and a peripheral flat rim 23. The above mentioned seat 13 of the base 12 of the plate is delimited by a circumferential step **13*a* over which the rim 23 of the disc 2 rests. It is to be noted that in this condition the rim portion 23 is arranged between the step 13*a* and the radial tabs 19*a* that exert an abutment and stop action on the same portion in a direction substantially parallel with the axis X and thus orthogonal with the plane over which the disc 2 generally lies. The levers 19 are kept in this condition by their elastic means, in the absence of an external operation and, as a consequence, the disc 2 is stably secured to the plate 1. In spite of that, the friction of the flat rim portion 23 on one side with the step 13*a*** and on the other side with the flange 10 is such, though exerting a certain resistance, is not such to prevent the rotation of the disc 2 around the axis X. In order to improve the stability of the coupling between the disc 2 and the plate 1 the flange 10 provides, at the diametrically opposed side with respect to the recess 14, three inwards radial protrusions 24, and the flat rim portion 23 of the disc 2 is blocked between these protrusions and the step 13*a*.

Figure 1:
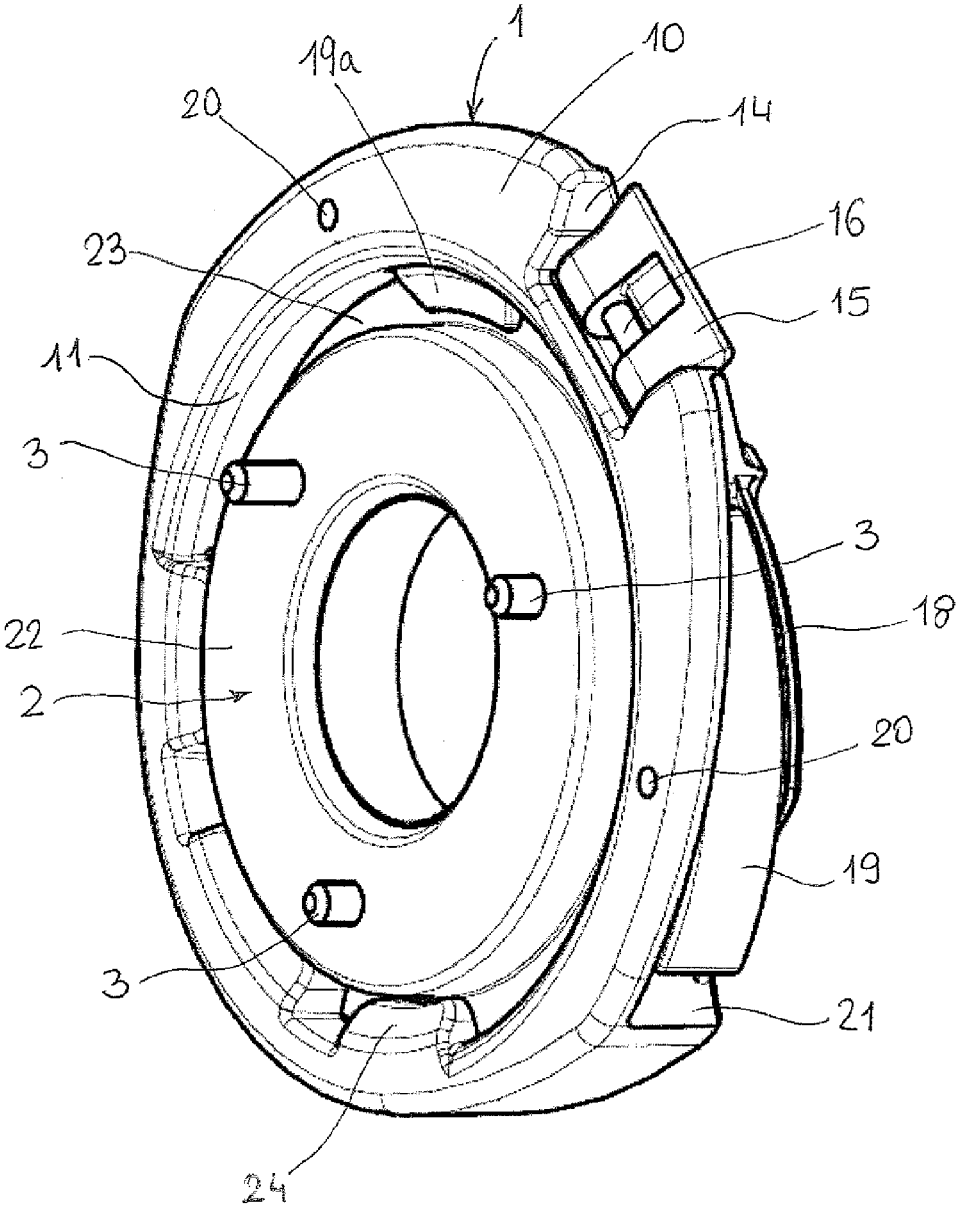
FIG. 1 is a perspective view of the holster support according to the present invention.
Figure 3:
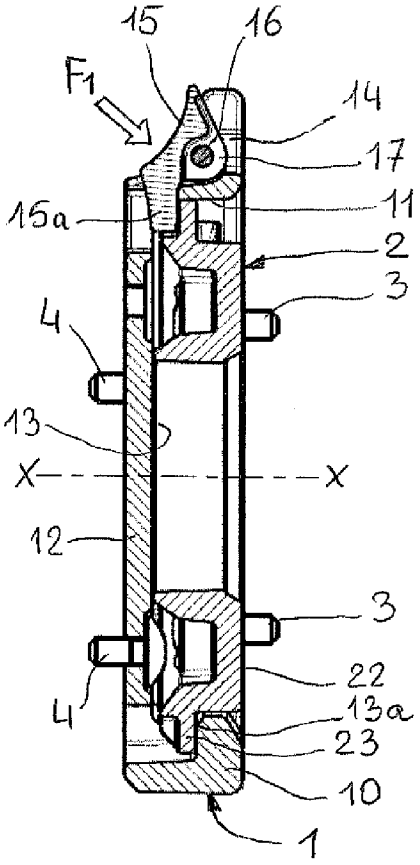
FIG. 3 is a diametrical cross section of the holster support taken along line III-III of FIG. 2.
Figure 2:
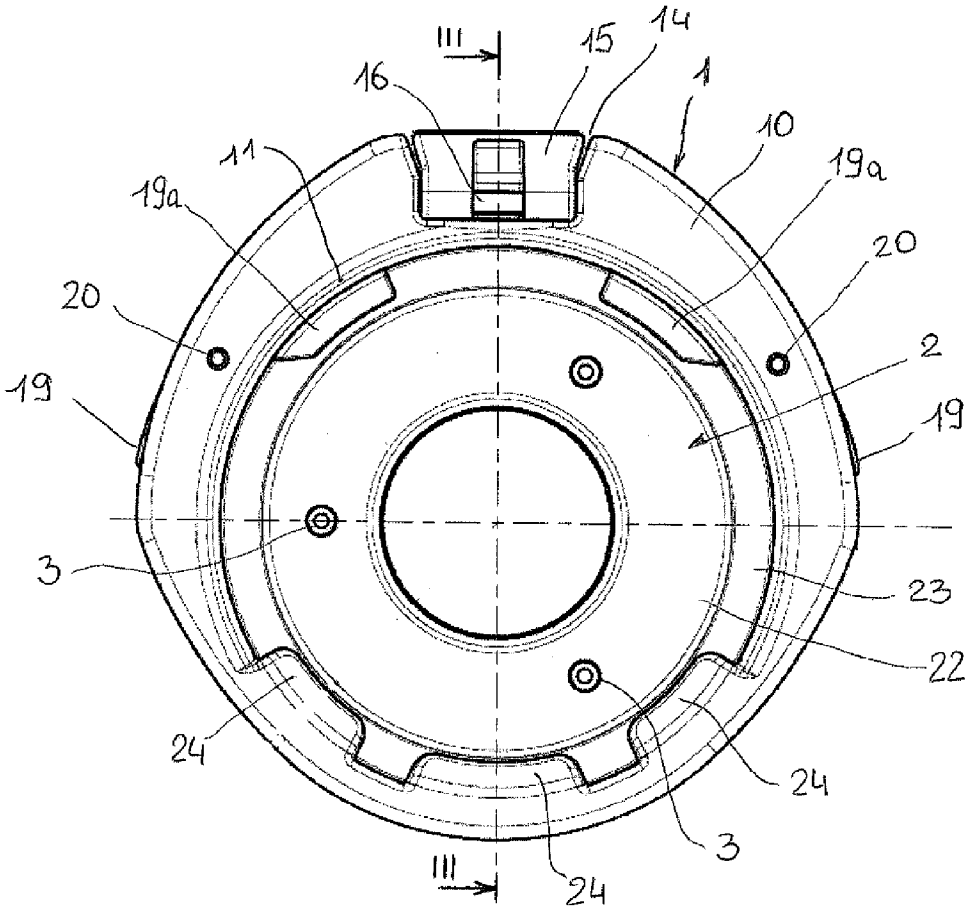
FIG. 2 is a front view of the holster support of FIG. 1.
Figure 5:
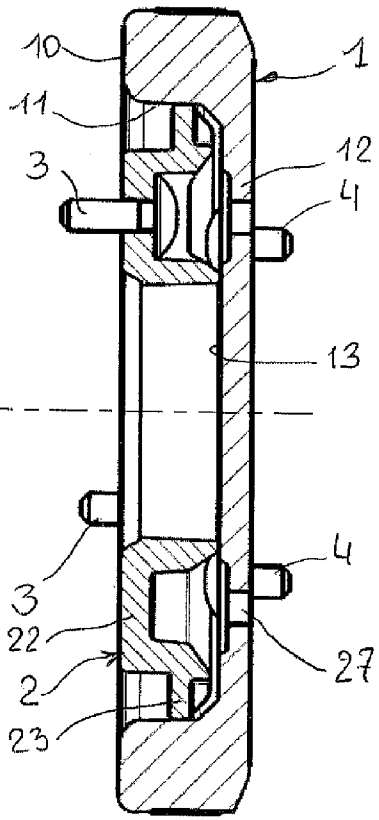
FIG. 5 s a diametrical cross section of the holster support taken along line IV-IV of FIG. 4.

In correspondence with the recess 14 the base 12 and the step 13*a* are broken by an opening 25 (visible in FIG. 6) through which a tooth 15*a* of the push-button 15 projects within the seat 13. A plurality of cavities 26 is formed over the side of the flat rim portion 23 of the disc 2 facing the step 13*a*, the cavities being angularly spaced in a regular fashion along the periphery, and being each adapted to engage with the tooth 15*a*. When this latter engagement occurs, any possibility of rotation of the disc 2 about the axis X is locked, whereas pushing the button 15 as indicated by the arrow F1 in FIG. 3, the tooth 15*a* is released from the cavity 26 with which it was engaged, allowing for the rotation of the disc 2 without however causing the detachment from the plate 1.

Figure 4:
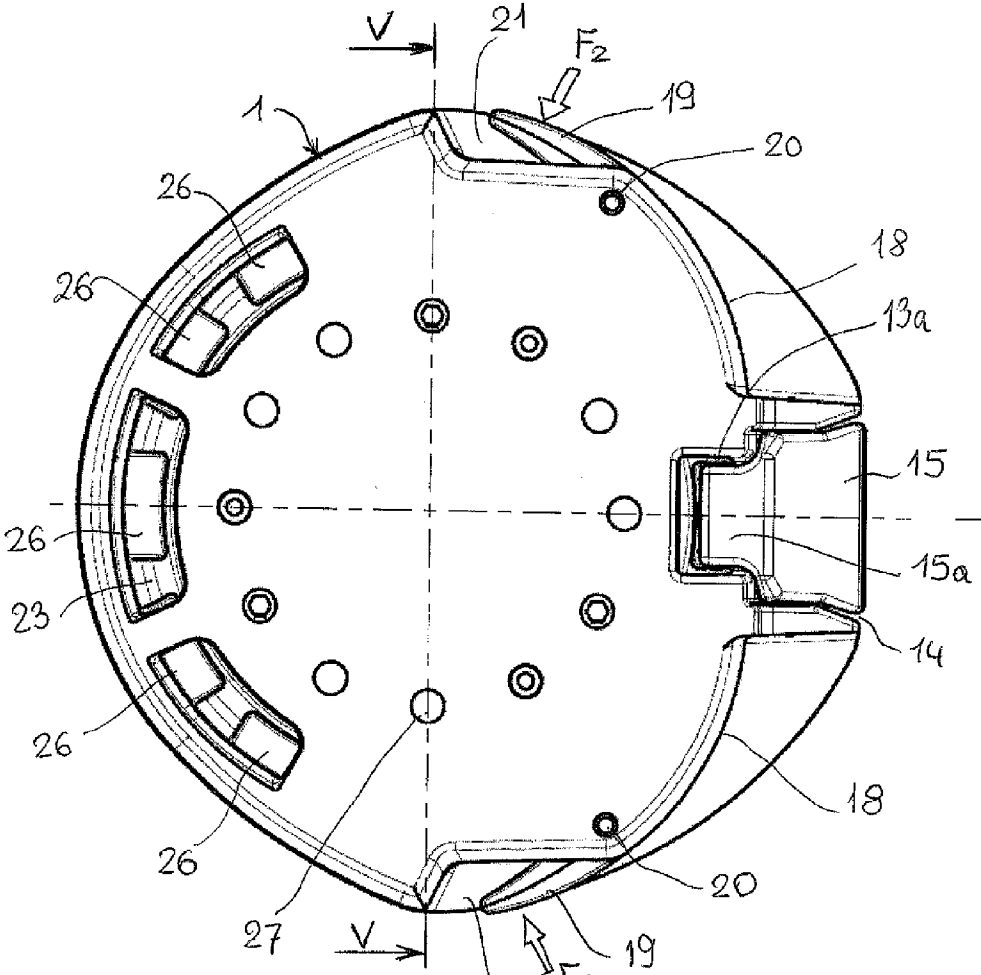
FIG. 4 is a rear view, rotated by 90°, of the holster support.
Figure 6:
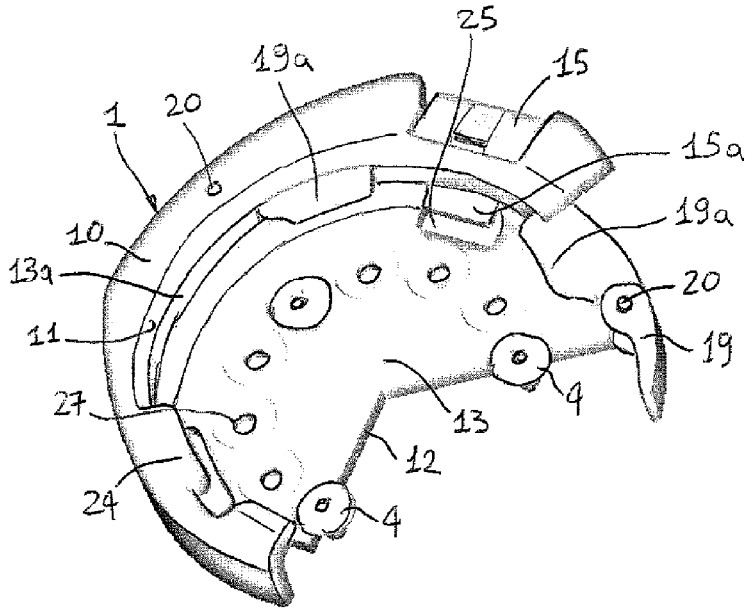
FIG. 6 is a partial perspective view of the holster support with parts removed in order to more clearly show some construction details.

As shown in FIGS. 4 and 6, the base 12 has a polar array of angularly equally spaced holes 27 for engagement with the screws 4 that permit to fasten the support according to the invention to a belt loop or other accessory. Since the screws are normally to be arranged on three vertexes of an equilateral triangle (this being required by the external attachment means or harness), it is preferable that, as in the example, the holes 27 are spaced by 30° (or other lower integer submultiples of 120°), so that it is possible to adjust the angular position of the button 15 and of the levers 19, depending on the user's requirements, choosing for the engagement of the screws 4 an appropriate group of three holes 27 mutually angled at 120°.

As a result of the rotation of the disc 2, to which the holster is fixed, carried out as described, it is possible to vary the inclination of the holster itself, locking it in the chosen position by means of the engagement of the tooth 15*a* in one of the cavities 26 formed in the disc 2. Since the cavities 26 are provided along the whole development of the flat rim portion 23, the inclination adjustment can be carried out in both directions of rotation throughout 360°.

The holster inclination adjustment step can be carried out without being it necessary to detach the holster from the support. Whenever this is instead required, it is sufficient to push radially the free ends of the levers 19, as indicated by the arrows F2 of FIG. 4, to make the tabs 19*a* at the other ends under the flange 10 of the plate 1 withdraw outwards, permitting to lift the disc on one side so as to disengage the flat rim portion 23 at the opposite side from the protrusions 24, and finally to remove the disc 2 from the plate 1.

The above description makes it clear that the objects of the invention are fully attained. The holster support according to the invention permits in fact to rotate the disc 2, and then the holster secured thereto, to a desired position throughout an angle of 360° without making it necessary to remove the holster. It is furthermore possible to arrange the plate 1, with the rotation-locking button 15 and with the disconnection preventing levers 19, in the desired position by choosing the appropriate holes, for the insertion of the screws 4 securing the plate 1 to the external attachment means or harness, chosen from the array of holes 27 of the base 12 of the same plate 1.

Variants and/or modifications can be brought to the holster support according to the present invention, without departing from the scope of the invention itself as defined by the following claims.

The invention claimed is:

1. A holster support comprising:

a plate adapted to be fixed to external attachment means, a disc to be secured to a holster, the disc generally extending over a plane and being rotationally connected to said plate about a disc axis orthogonal with said plane, and said plate being adapted with a push-button locking means for locking the rotation of said disc about said disc axis so as to releasably lock said disc in a selected angular position with respect to said plate, wherein a plurality of cavities are formed on a periphery of said disc, the cavities being angularly spaced in a regular fashion over said periphery, wherein said push-button locking means comprises at least one push-button elastically hinged to said plate around a button axis parallel with the plane of the disc and is selectively engageable in one of said cavities, and wherein the support further comprises at least one lever pivotally connected to said plate around a lever axis parallel with said disc axis orthogonal to said plane of said disc, with elastic means hindering the pivoting, said at least one lever providing an abutment to said disc in a direction substantially orthogonal to its plane, whereby the separation of the disc from said plate is prevented by said abutment, while a radial push on said at least one lever and against said elastic means permits said disc to disengage allowing removal of said disc from said plate.

2. The holster support according to claim 1, wherein said disc comprises a flat rim peripheral portion in which said cavities are formed, said plate comprising a base defining a seat for housing said disc delimited by a step, said flat rim portion abutting against said step.

3. The holster support according to claim 2, wherein said plate comprises an annular flange, said push-button locking means and said at least one lever being pivotally connected to said flange.

4. The holster support according to claim 3, wherein in said flange there is formed a radial recess housing for accommodating said push-button locking means outside said seat, and two housings for respective levers in a mutual symmetry with respect to said recess.

5. The holster support according to claim 4, wherein in correspondence with said recess said base and said step are broken by an opening through which a tooth of said push-button locking means projects inside said seat for engaging with one of said cavities.

6. The holster support according to claim 3, wherein said abutment is provided for each lever by a radial end tab projecting within said seat through windows formed in said flange, said flat rim portion of said disc being placed between said tabs and said step.

7. The holster support according to claim 3, wherein said flange provides a number of inwards radial protrusions said flat rim portion of said disc being blocked between said protrusions and said step.

8. The holster according to claim 3, wherein said levers are arranged inside respective housings of said flange and pivotally connected, via pivots, to the plate with elastic means hindering the pivoting.

9. The holster support according to claim 2, wherein a circular array of angularly equally spaced holes is formed in said base for selective engagement with screws that permit to fasten the support to said external attachment.

10. The holster according to claim 9, wherein said holes are spaced by 30° or other lower integer submultiples of 120°, whereby it is possible to adjust the angular position of the button and of the at least one lever, depending on the user's requirements, choosing for the engagement of the screws an appropriate group of three holes mutually angled at 120°.

* * * * *